US008059085B2

(12) United States Patent
Lee et al.

(10) Patent No.: US 8,059,085 B2
(45) Date of Patent: Nov. 15, 2011

(54) METHOD OF CONTROLLING LUMINANCE OF BACKLIGHT ASSEMBLY, CIRCUIT FOR CONTROLLING LUMINANCE OF BACKLIGHT ASSEMBLY AND DISPLAY DEVICE HAVING THE SAME

(75) Inventors: Joo-Hyung Lee, Gwacheon-si (KR); Kee-Han Uh, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1043 days.

(21) Appl. No.: 11/874,243

(22) Filed: Oct. 18, 2007

(65) Prior Publication Data

US 2008/0094347 A1 Apr. 24, 2008

(30) Foreign Application Priority Data

Oct. 20, 2006 (KR) ..... 10-2006-0102355
Aug. 21, 2007 (KR) ..... 10-2007-0083771

(51) Int. Cl.
*G09G 3/36* (2006.01)

(52) U.S. Cl. ..... 345/102; 345/98

(58) Field of Classification Search ..... 345/102, 345/87, 98, 100; 348/227.1, 602, 603
See application file for complete search history.

(56) References Cited

U.S. PATENT DOCUMENTS 5,416,385 A * 5/1995 Hau ..... 315/151
2007/0109239 A1* 5/2007 den Boer et al. ..... 345/87

FOREIGN PATENT DOCUMENTS

JP 2003-215534 7/2003
KR 1020030075317 A 9/2003
KR 102005005267 A 6/2005

* cited by examiner

*Primary Examiner* — Ricardo L Osorio
(74) *Attorney, Agent, or Firm* — F. Chau & Associates, LLC

(57) ABSTRACT

A method for controlling a backlight luminance in which a reference voltage is set, a sampling voltage is generated based on the reference voltage, and a net photo current signal is generated by a photo current sensing element and a dark current sensing element. The net photo current signal is generated independently of temperature variations. A luminance control signal is generated based on the sampling voltage. The luminance of the backlight assembly is controlled using the luminance control signal. Therefore, variation of the luminance of the backlight assembly may be minimized, although external luminance, temperature, and variation between different photo sensors, the deterioration of the elements, and the like, may be changed.

10 Claims, 10 Drawing Sheets

METHOD OF CONTROLLING LUMINANCE OF BACKLIGHT ASSEMBLY, CIRCUIT FOR CONTROLLING LUMINANCE OF BACKLIGHT ASSEMBLY AND DISPLAY DEVICE HAVING THE SAME

CROSS-REFERENCE TO RELATED APPLICATIONS

The present application claims priority under 35 U.S.C. §119 to Korean Patent Application No. 2006-102355, filed on Oct. 20, 2006, and Korean Patent Application No. 2007-83771, filed on Aug. 21, 2007 in the Korean Intellectual Property Office (KIPO), the contents of which are herein incorporated by reference in their entireties.

BACKGROUND OF THE INVENTION

1. Technical Field

The present disclosure relates to a method of controlling the luminance of a backlight assembly, a circuit for controlling the luminance of the backlight assembly, and a display device having the circuit for controlling the luminance of the backlight assembly. More particularly, the present disclosure relates to a method of controlling the luminance of a backlight assembly used for a display device, a circuit for controlling the luminance of the backlight assembly, which is capable of improving luminance uniformity, and a display device having the circuit for controlling the luminance of the backlight assembly.

2. Discussion of Related Art

Recently, a liquid crystal display (LCD) device capable of controlling the luminance of a backlight module has been developed. The LCD device controls the luminance of the backlight module by detecting the luminance of externally provided light using a photo-sensing part that is integrated onto a panel to control the luminance of a backlight module, thereby optimizing display characteristics.

The LCD device, however, ignores a variation of an output of a photo sensor, which is caused by temperature change, and a variation between outputs of a plurality of the photo sensors. Also, deterioration of a thin-film transistor (TFT) of the photo sensor caused by long-term use is also ignored.

SUMMARY OF THE INVENTION

Exemplary embodiments of the present invention provide a method of controlling the luminance of a backlight assembly used for a display device.

In addition, exemplary embodiments of the present invention provide a circuit for controlling the luminance of the above-mentioned backlight assembly, which is capable of improving luminance uniformity.

Furthermore, the present invention provides a display device having the above-mentioned circuit for controlling the luminance of the backlight assembly.

According to exemplary embodiments of methods of controlling the luminance of a backlight assembly of the present invention, a net photo current signal independent from temperature variation is generated, and the luminance of a backlight assembly is controlled using the net photo current signal. Alternatively, a photo current signal or a net photo current signal dependent on temperature variations may be generated, and a luminance control signal, of which dependence on temperature has been removed through a sampling timing signal and the photo current signal or the net photo current signal, controlling the luminance of the backlight assembly may be generated.

A method of controlling luminance of a backlight assembly in accordance with an exemplary embodiment of the present invention is provided as follows. The luminance of the backlight assembly may be controlled using a net photo current signal independent from temperature variation. A reference voltage is set. A sampling voltage is generated based on the reference voltage and the net photo current signal generated by a photo current sensing element and a dark current sensing element. The size of the net photo current signal is generated independently of temperature variations. A luminance control signal is generated based on the sampling voltage. The luminance of the backlight assembly is controlled using the luminance controlling signal.

The luminance control signal may be generated by changing a plurality of the analog sampling voltages into a plurality of digital sampling signals, storing the digital sampling signals, and outputting an average value of a strong signal of the stored digital sampling signals as the luminance controlling signal. The luminance controlling signal may be generated after the steps of setting the reference voltage, generating the sampling voltage, generating the digital sampling signal, and storing the digital sampling signal, are repeated a plurality of times.

A method of controlling luminance of a backlight assembly in accordance with an exemplary embodiment of the present invention is provided as follows. The luminance of the backlight assembly may be controlled using a photo current signal or a net photo current signal dependent on temperature variation. A sampling timing signal is calibrated. A reference voltage is set. A sampling voltage is generated based on a net photo current or a photo current signal generated by a photo current sensing element and/or a dark current sensing element with reference to the reference voltage. A luminance control signal is generated based on the sampling voltage and the sampling timing signal. The luminance of the backlight assembly is controlled using the luminance controlling signal.

The luminance control signal may be generated by changing a plurality of the analog sampling voltages into a plurality of digital sampling signals, storing the digital sampling signals, and outputting an average value of a strong signal of the stored digital sampling signals as the luminance controlling signal. The luminance controlling signal may be generated after the steps of setting the reference voltage, generating the sampling voltage, generating the digital sampling signal and storing the digital sampling signal are repeated a plurality of times.

The sampling timing signal may be calibrated by generating a calibrating voltage based on the reference voltage and a dark current signal generated by the dark current sensing element, converting the analog calibrating voltage into a digital calibrating signal, encoding the digital calibrating signal to generate an encoded signal, and generating the sampling timing signal based on the encoded signal.

According to display devices of exemplary embodiments of the present invention, a net photo current signal independent from temperature variations is generated in a circuit for controlling the luminance of a backlight assembly. Alternatively, a photo current signal or a net photo current signal dependent on temperature variation may be generated, and a luminance control signal, of which dependence on temperature has been removed through a sampling timing signal and photo current signal or the net photo current signal, for controlling the luminance of the backlight assembly may be generated.

A circuit for controlling the luminance of a backlight assembly in accordance with an exemplary embodiment of the present invention includes a photo-sensing part, an amplifier, a sampler and an analog-to-digital converter (ADC). The luminance of the backlight assembly may be controlled using a net photo current signal independent from temperature variation. The photo-sensing part includes a photo current sensing element and a dark current sensing element to output the net photo current signal that is independent from temperature variations of the photo current sensing element and the dark current sensing element. The amplifier holds a voltage level applied to an output terminal of the photo-sensing part. The amplifier receives the net photo current signal outputted from the photo-sensing part to amplify the received net photo current signal. The sampler is electrically connected to an output terminal of the amplifier to generate a sampling voltage and to output the sampling voltage. The ADC converts the analog sampling voltage from the sampler into a digital sampling signal.

The circuit for controlling the luminance of the backlight assembly may further include an operating portion storing a plurality of the digital sampling signals and outputting an average value of a strong signal of the digital sampling signals as a luminance controlling signal. The photo-sensing part may further include a plurality of photo sensors including a photo current sensor and a dark current sensor.

A circuit for controlling the luminance of a backlight assembly in accordance with an exemplary embodiment of the present invention includes a photo-sensing part, an amplifier, a sampler, and an ADC. The luminance of the backlight assembly may be controlled using a photo current signal or a net photo current signal dependent on temperature variation. The photo-sensing part includes a photo current sensing element and a dark current sensing element to output the photo current signal, a dark current signal or the net photo current signal. The amplifier holds a voltage level applied to an output terminal of the photo-sensing part. The amplifier receives an output of the photo-sensing part to amplify the output of the photo-sensing part. The sampler is electrically connected to an output terminal of the amplifier to generate a calibrating voltage or a sampling voltage and to output the calibrating voltage or the sampling voltage. The ADC converts the analog calibrating voltage and the analog sampling voltage from the sampler into a digital calibrating signal and a digital sampling signal, respectively.

The circuit for controlling the luminance of the backlight assembly may further include an operating portion storing a plurality of the digital sampling signals and outputting an average value of a strong signal of the digital sampling signals as a luminance controlling signal. The photo-sensing part may further include a plurality of photo sensors including a photo current sensor and a dark current sensor.

The circuit for controlling the luminance of the backlight assembly may further include an encoder that encodes an n-bit digital calibrating signal that is output from the ADC into an m-bit encoded signal, and a counter generating a sampling timing signal based on the encoded signal that is output from the encoder, where m and n are natural numbers. The sampler generates the sampling voltage based on the sampling timing signal.

A display device in accordance with an exemplary embodiment of the present invention includes a display panel, a backlight assembly, and a circuit for controlling the luminance of the backlight assembly. The display panel displays an image and has a light-blocking region. An open portion is formed in the light-blocking region. A photo-sensing part of the circuit for controlling the luminance of the backlight assembly is exposed through the open portion to receive externally provided light.

According to an exemplary embodiment of the method of controlling the luminance of a backlight assembly, the circuit for controlling the luminance of the backlight assembly, and the display device having the circuit for controlling the luminance of the backlight assembly of the present invention, variation of the luminance of the backlight assembly may be minimized, although external luminance, temperature, variation between different photo sensors, deterioration of the elements, and the like, may be changed.

BRIEF DESCRIPTION OF THE DRAWINGS

Exemplary embodiments of the present invention will be understood in more detail from the following descriptions taken in conjunction with the accompanying drawings, in which.

DESCRIPTION OF EXEMPLARY EMBODIMENTS

The present invention is described more fully hereinafter with reference to the accompanying drawings, in which exemplary embodiments are shown. This invention may, however, be embodied in many different forms and should not be construed as limited to the exemplary embodiments set forth herein. Rather, these exemplary embodiments are provided so that this disclosure will be thorough and complete, and will fully convey the scope of the invention to those of ordinary skill in the art.

Figure 1:
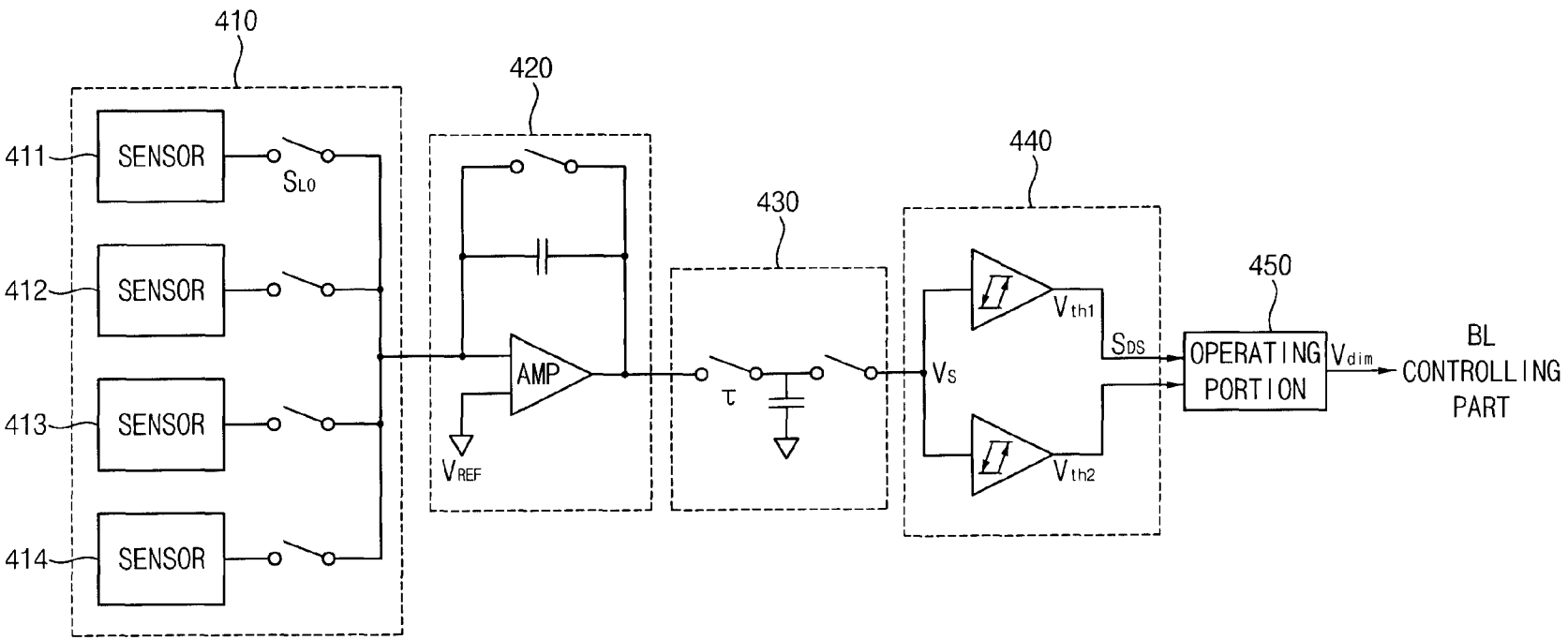
FIG. 1 is a circuit diagram illustrating a circuit for controlling the luminance of a backlight assembly in accordance with an exemplary embodiment of the present invention.
Figure 2A:
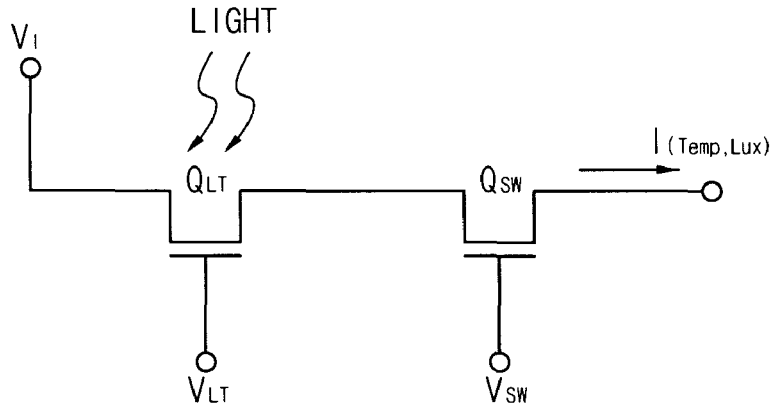
FIG. 2A is a circuit diagram illustrating an exemplary embodiment of a photo sensor used in the circuit shown in FIG. 1.
Figure 2B:
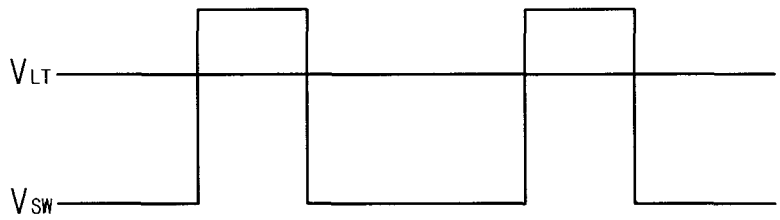
FIG. 2B is a timing diagram illustrating signals applied to the photo sensor shown in FIG. 2A.
Figure 3A:
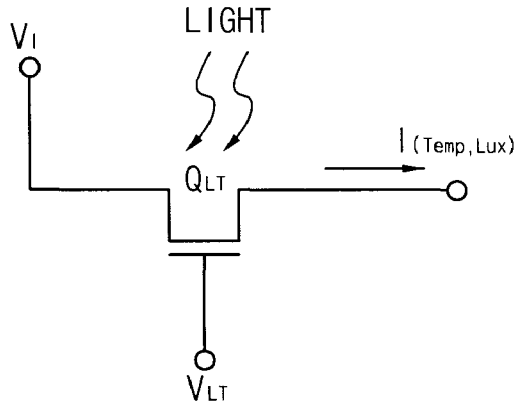
FIG. 3A is a circuit diagram illustrating a photo sensor in accordance with an exemplary embodiment of the present invention.
Figure 3B:
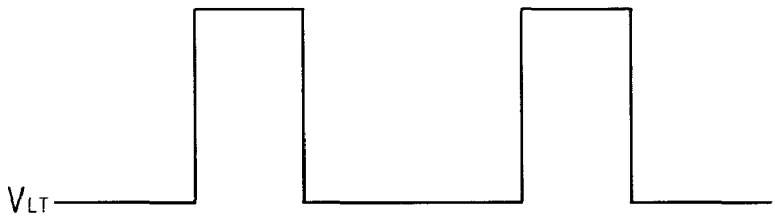
FIG. 3B is a timing diagram illustrating signals applied to the photo sensor shown in FIG. 3A.

FIG. 1 is a circuit diagram illustrating a circuit for controlling the luminance of a backlight assembly in accordance with an exemplary embodiment of the present invention. FIG. 2A is a circuit diagram illustrating a photo sensor used in the circuit shown in FIG. 1. FIG. 2B is a timing diagram illustrating signals applied to the photo sensor shown in FIG. 2A. FIG. 3A is a circuit diagram illustrating a photo sensor in accordance with an exemplary embodiment of the present invention. FIG. 3B is a timing diagram illustrating signals applied to the photo sensor shown in FIG. 3A.

Referring to FIG. 1, the circuit for controlling the luminance of a backlight assembly (not shown) includes a photo-sensing part 410, an amplifier 420, a sampler 430, a signal converter 440, and an operating portion 450. The photo-sensing part 410 includes a plurality of light sensors 411, 412, 413, and 414. As shown in FIG. 2A, each of the photo sensors 411, 412, 413 and 414 includes a photo current sensing element $Q_{LT}$ and a switching element $Q_{SW}$. As shown in FIG. 3A, each of the photo sensors 411, 412, 413 and 414 includes only the photo current sensing element $Q_{LT}$, but does not include the switching element $Q_{SW}$.

Referring to FIGS. 1, 2A and 2B, the operation of the circuit for controlling the backlight assembly will be explained as follows.

When light is irradiated onto a semiconductor of a channel portion of the photo current sensing element $Q_{LT}$, a portion of the electrons in a valence band is transferred into a conduction band to form free electrons. When a control signal $V_{SW}$ is applied to a control electrode of the switching element $Q_{SW}$, the channel of the switching element $Q_{SW}$ is opened and a corresponding output control switch $S_{LO}$ is turned on, so that a photo current $I_{(Temp,\ Lux)}$ induced by an input voltage $V_I$ is outputted as a sensing signal.

The amplifier 420 generates an amplified sampling voltage $V_S$ based on the sensing signal from the photo-sensing part 410 to output the sampling voltage $V_S$ to the sampler 430. The sampler 430 samples the sampling voltage $V_S$ based on a sampling timing signal T to output the sampled sampling voltage $V_S$ to the signal converter 440.

The signal converter 440 includes a plurality of comparators. The signal converter 440 converts the analog sampling voltage $V_S$, which is sampled by the sampler 430, into a digital sampling signal $S_{DS}$ and outputs the digital sampling signal $S_{DS}$ to the operating portion 450. The operating portion 450 receives four digital sampling signals $S_{DS}$ corresponding to the four photo-sensing elements 411, 412, 413 and 414 in every predetermined period, and stores the received four digital sampling signals $S_{DS}$ using a memory portion (not shown). The operating portion 450 compares the four digital sampling signals $S_{DS}$ to determine a strong signal of the four digital sampling signals $S_{DS}$ as an external luminance signal. Thus, the operating portion 450 changes the level or state of a luminance controlling signal $V_{Dim}$ based on the external luminance signal and applies the luminance controlling signal $V_{Dim}$ to a controlling part of the backlight assembly (not shown). The controlling part of the backlight assembly controls the luminance of the backlight assembly based on the luminance controlling signal $V_{Dim}$ to optimize the luminance of the backlight assembly in accordance with the external luminance and to decrease power consumption.

Figure 4A:
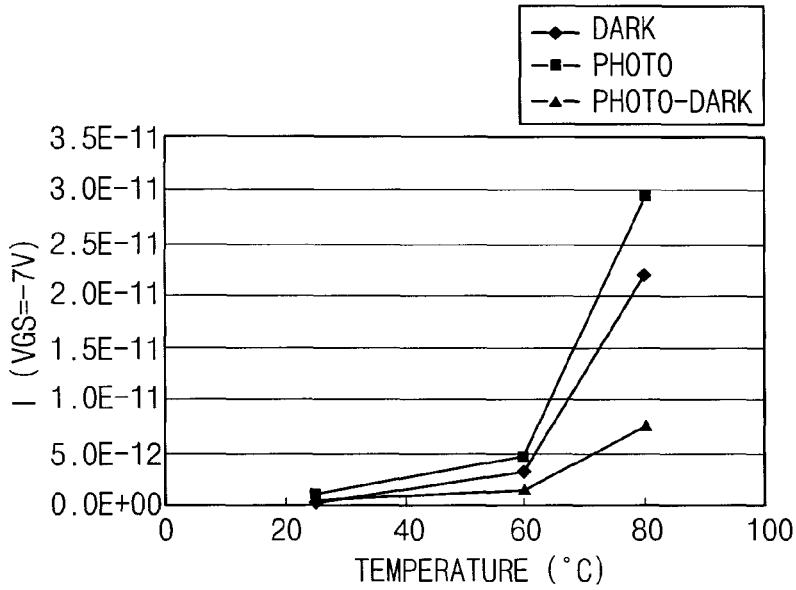
FIGS. 4A to 4C are graphs illustrating variation of a photo current, a dark current, and a net photo current based on various gate source voltages Vgs and temperatures.
Figure 4B:
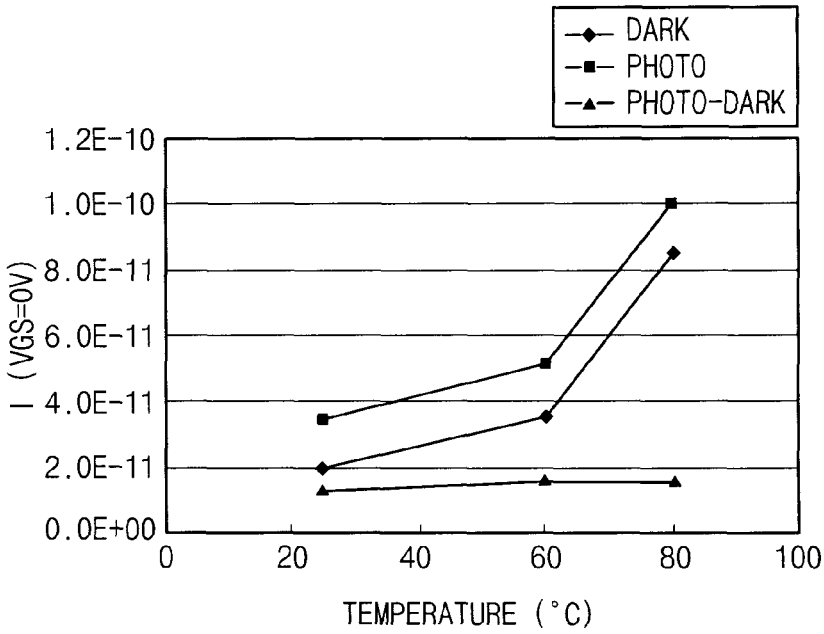
Figure 4C:
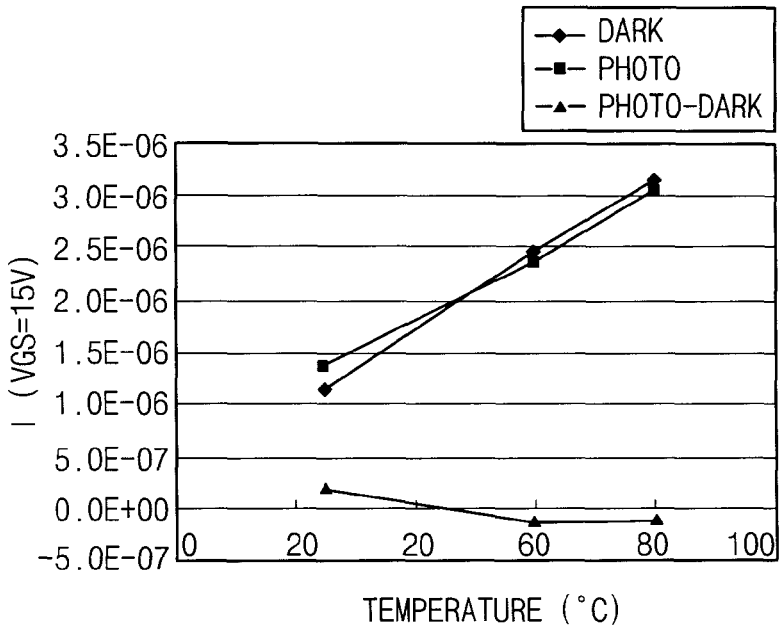

FIGS. 4A, 4B, and 4C are graphs illustrating variation of a photo current, a dark current and a net photo current based on various gate-source voltages Vgs and temperatures. In FIGS. 4A, 4B, and 4C, the gate-source voltages Vgs are different from each other, and a relationship between temperature and currents that includes the photo current $I_{(Temp.\ Lux)}$, the dark current $I_{(Temp)}$, and the net photo current $I_{(Lux)}$ is displayed. The net photo current $I_{(Lux)}$ is substantially equal to the photo current $I_{(Temp,\ Lux)}$ after subtracting the dark current $I_{(Temp)}$. In FIGS. 4A, 4B, and 4C, an external luminance is about 10,000 lux.

When the temperature is increased, the photo current $I_{(Temp,\ Lux)}$ and the dark current $I_{(Temp)}$ are also increased. The net photo current $I_{(Lux)}$ that equals the photo current $I_{(Temp,\ Lux)}$ minus the dark current $I_{(Temp)}$, however, is changed based on variations of the gate-source voltage Vgs. When the gate-source voltage Vgs is about −7 V, the net photo current $I_{(Lux)}$ is increased as the temperature is increased. When the gate-source voltage Vgs is about 0 V, the net photo current $I_{(Lux)}$ maintains a substantially constant value as the temperature is increased. When the gate-source voltage Vgs is about 15 V, the net photo current $I_{(Lux)}$ is decreased as the temperature is increased.

Therefore, when the gate-source voltage Vgs is about 0 V, the external luminance may be detected using the net photo current $I_{(Lux)}$ with decreased error even though the temperature changes. When the gate-source voltage Vgs is about 0 V, however, the order of the amount of the net photo current $I_{(Lux)}$ is $10^{-11}$, so that error of the net photo current $I_{(Lux)}$ may be increased after the net photo current $I_{(Lux)}$ is amplified. In addition, the amount of the net photo current $I_{(Lux)}$ is dependent on deviations between the photo sensors, which are changed by the deterioration of the channel portion of the photo sensor due to long-term use.

Therefore, the gate-source voltage Vgs of a high level is required, and the photo sensors having low deviation are also required to decrease the amount of the error. When the level of the gate-source voltage Vgs is increased, the net photo current $I_{(Lux)}$ is dependent on the temperature, so that calibration for temperature variation is required.

The calibration is performed as follows. The effect of the external luminance is removed to generate the dark current $I_{(Temp)}$ and the temperature is detected. The time period for summing the net photo current $I_{(Lux)}$ is standardized. An amount of the summation of the net photo current $I_{(Lux)}$ for the standardized time period is detected, and the luminance controlling signal is generated.

When the calibration is performed, the standardized time period is changed based on the temperature variation, the difference between the photo-sensing elements, and the deterioration caused by long time use, so that the error caused by the temperature, the photo-sensing element, and the deterioration in controlling the luminance may be minimized. In addition, although the external luminance is detected, the external luminance may be detected using the output that is dependent on the temperature. For example, the external luminance may be detected without the net photo current $U_{(Lux)}$, and the external luminance may be detected using the photo current $I_{(Temp,\ Lux)}$.

Figure 5A:
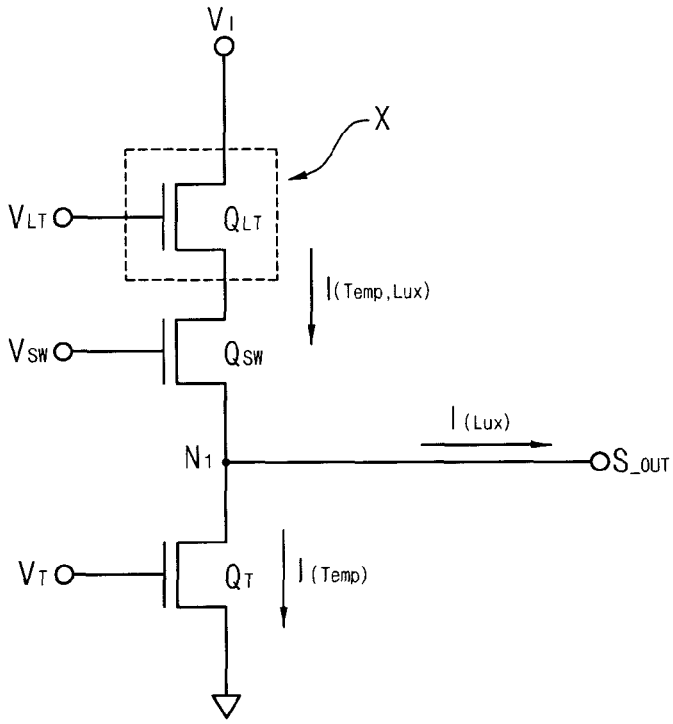
FIG. 5A is a circuit diagram illustrating a photo sensor in accordance with an exemplary embodiment of the present invention.
Figure 5B:
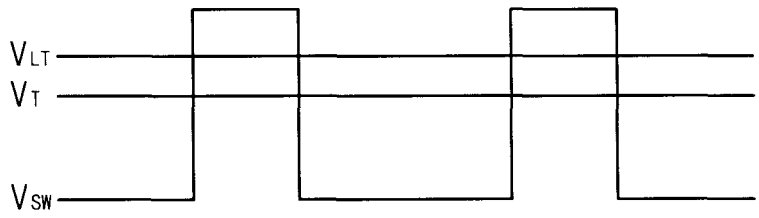
FIG. 5B is a timing diagram illustrating signals applied to the photo sensor shown in FIG. 5A.

FIG. 5A is a circuit diagram illustrating a photo sensor in accordance with an exemplary embodiment of the present invention. FIG. 5B is a timing diagram illustrating signals applied to the photo sensor shown in FIG. 5A.

Referring to FIGS. 5A and 5B, the photo sensor includes a photo current sensing element $Q_{LT}$, a dark current sensing element $Q_T$, and a switching element $Q_{SW}$. Each of the photo current sensing element $Q_{LT}$, the dark current sensing element $Q_T$, and the switching element $Q_{SW}$ may comprise a thin-film transistor (TFT) that includes a semiconductor channel region. The semiconductor channel region may include amorphous silicon or polycrystalline silicon. The number of carriers in the semiconductor channel region may be changed based on luminance and temperature.

An input voltage $V_I$ and a control signal $V_{LT}$ for controlling the photo current sensing element are applied to a drain electrode and a gate electrode of the photo current sensing element $Q_{LT}$, respectively. A source electrode of the photo current sensing element $Q_{LT}$ is electrically connected to a drain electrode of the switching element $Q_{SW}$. A control signal $V_{SW}$ for controlling the switching element is applied to a gate electrode of the switching element $Q_{SW}$, and a source electrode of the switching element $Q_{SW}$ is electrically connected an output terminal $S_{OUT}$ and a drain electrode of the dark current sensing element $Q_T$ through a first node $N_1$. A control signal $V_T$ for controlling the dark current sensing element is applied to a gate electrode of the dark current sensing element $Q_T$, and a source electrode of the dark current sensing element $Q_T$ is electrically connected to a constant voltage terminal.

A light-blocking region, such as a black matrix, includes an open portion X on an upper portion of the channel region of the photo current sensing element $Q_{LT}$, so that the number of carriers formed in the channel region of the photo current sensing element $Q_{LT}$ is changed by the external luminance and the temperature.

In contrast, an upper portion of the channel region of the dark current sensing element $Q_T$ is blocked by the black matrix, so that the number of the carriers formed in the channel region of the dark current sensing element $Q_T$ is not changed by the external luminance but is changed by the temperature.

Therefore, as shown in FIG. 5B, when the input voltage $V_I$, the control signal $V_{LT}$ for controlling the photo current sensing element, the control signal $V_T$ for controlling the dark current sensing element, and the high level control signal $V_{SW}$ for controlling the switching element are applied to the drain electrode of the photo current sensing element $Q_{LT}$, the gate electrode of the photo current sensing element $Q_{LT}$, the gate electrode of the dark current sensing element $Q_T$, and the gate electrode of the switching element $Q_{SW}$, respectively, the photo current $I_{(Temp,\ Lux)}$ that is dependent on the external luminance and the temperature in the channel region of the photo current sensing element $Q_{LT}$ flows toward the first node $N_1$, and the dark current $I_{(Temp)}$ that is dependent on the temperature of the channel region of the dark current sensing element $Q_T$ flows between the first node $N_1$ and the constant terminal.

Therefore, when the photo current sensing element $Q_{LT}$ has substantially the same design as the dark current sensing element $Q_T$ and a drain-source voltage Vds of the photo current sensing element $Q_{LT}$ is substantially the same as the gate-source voltage Vgs of the dark current sensing element $Q_T$, the net photo current $I_{(Lux)}$ that substantially equals the photo current $I_{(Temp,\ Lux)}$ after subtracting the effect of temperature in the channel region of the photo current sensing element $Q_{LT}$ is applied to the output terminal $S_{OUT}$.

Figure 6A:
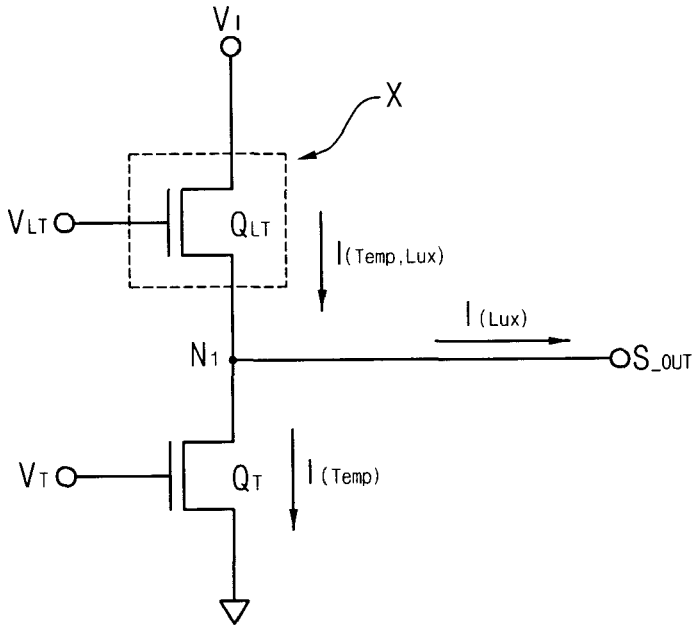
FIG. 6A is a circuit diagram illustrating a photo sensor in accordance with an exemplary embodiment of the present invention.
Figure 6B:
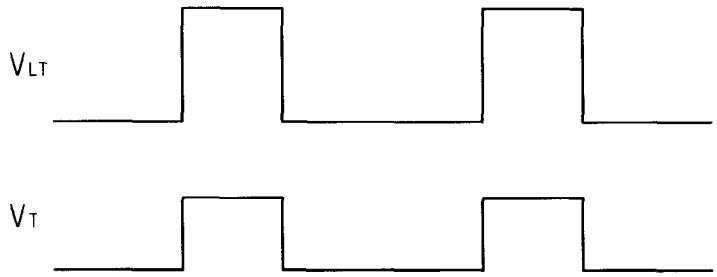
FIG. 6B is a timing diagram illustrating signals applied to the photo sensor shown in FIG. 6A.

FIG. 6A is a circuit diagram illustrating a photo sensor in accordance with an exemplary embodiment of the present invention. FIG. 6B is a timing diagram illustrating signals applied to the photo sensor shown in FIG. 6A.

Referring to FIGS. 6A and 6B, the switching element $Q_{SW}$ (shown in FIG. 5A) is omitted, and a source electrode of the photo current sensing element $Q_{LT}$ is directly electrically connected to an output terminal $S_{OUT}$ and a drain electrode of a dark current sensing element $Q_T$ through a first node $N_1$. Therefore, an output signal is not generated based on all of the control signal $V_{LT}$ for controlling the photo current sensing element $Q_{LT}$, a control signal VT for controlling the dark current sensing element, and a pulse type control signal $V_{SW}$ for controlling the switching element applied to the switching element $Q_{SW}$ as shown in FIGS. 5A and 5B, but is generated based only on the pulse type control signal $V_{LT}$ for controlling photo current sensing element and the control signal $V_T$ for controlling the dark current sensing element, as shown in FIGS. 6A and 6B, so that the output signal may be directly formed based on the pulse type control signal $V_{LT}$ for controlling the photo current sensing element and the control signal $V_T$ for controlling the dark current sensing element.

Figure 7A:
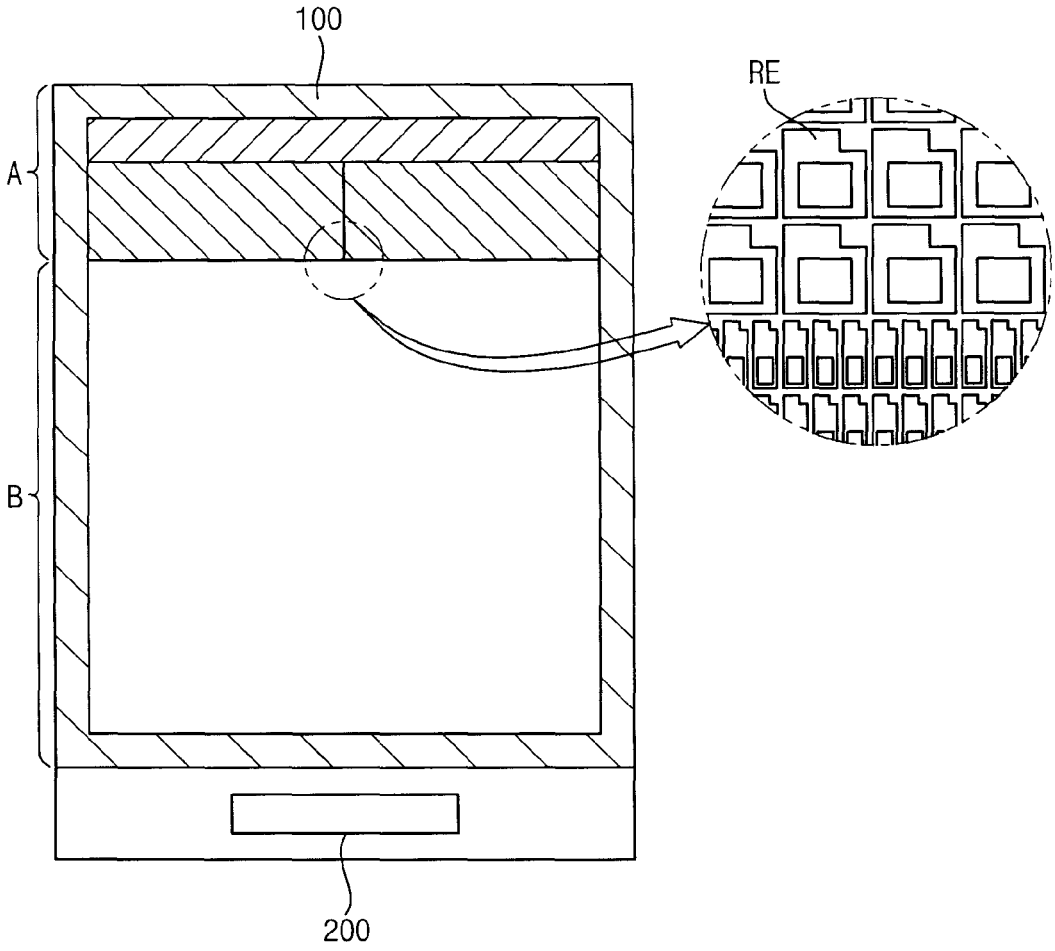
FIG. 7A is a plan view illustrating a display device including a circuit for controlling the luminance of a backlight assembly in accordance with an exemplary embodiment of the present invention.
Figure 7B:
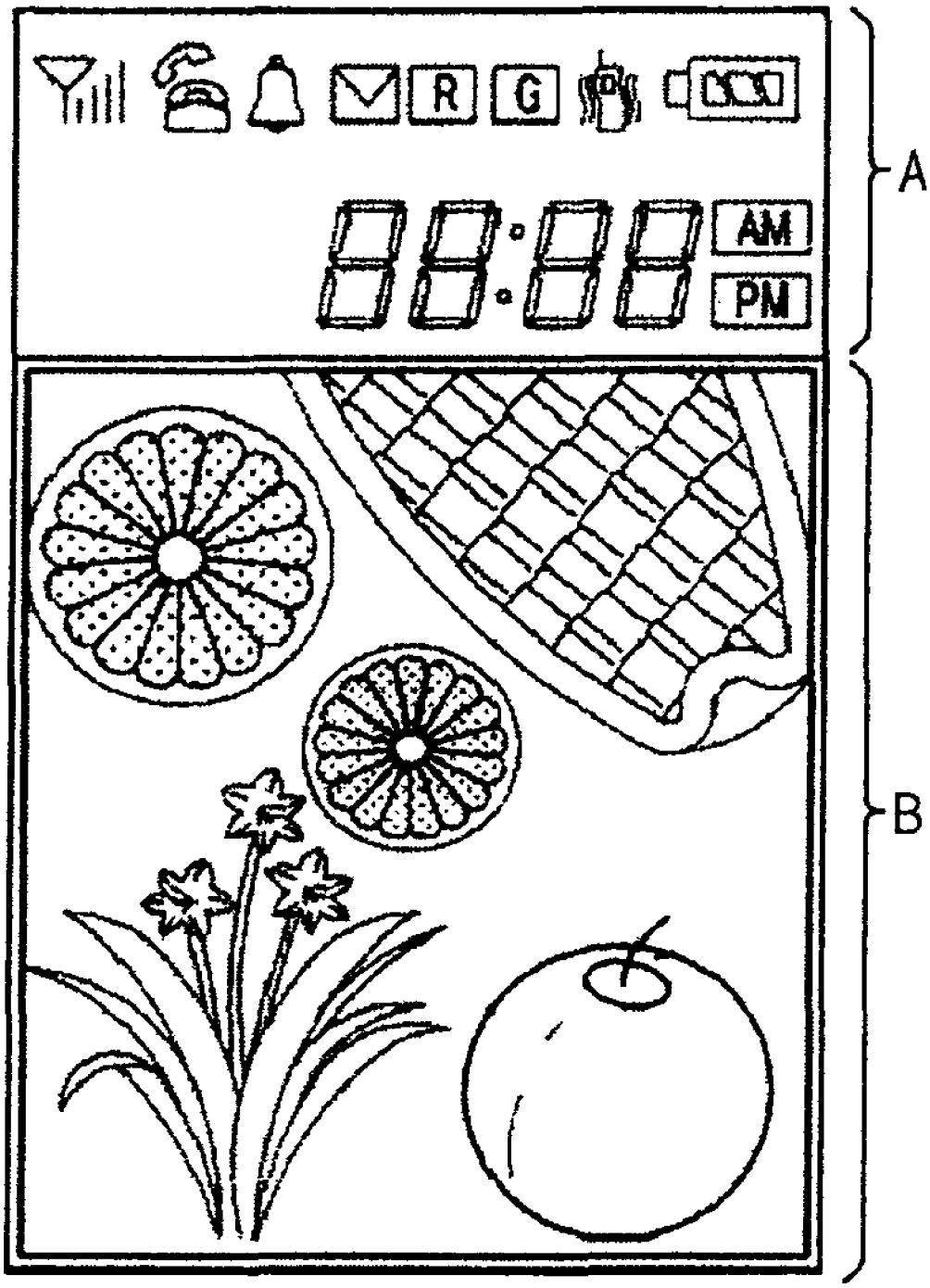
FIG. 7B is a plan view illustrating a screen of the display device shown in FIG. 7A.

FIG. 7A is a plan view illustrating a display device including a circuit for controlling the luminance of a backlight assembly in accordance with an exemplary embodiment of the present invention. FIG. 7B is a plan view illustrating a screen of the display device shown in FIG. 7A.

Referring to FIGS. 7A and 7B, the display device having a circuit for controlling the luminance of the backlight assembly (not shown) is a section display type. In the section display type, the display device has a constant display region 'A' and a normal display region B.

A photo sensor of the circuit for controlling the luminance of the backlight assembly (not shown) includes a TFT having a channel region. The channel region of the TFT may include amorphous silicon or polycrystalline silicon. The photo sensor of the circuit for controlling the luminance of the backlight assembly may be directly formed on a display substrate of the display device through a thin-film process. For example, the photo sensor may be formed in a light-blocking region 100 or under a reflective electrode RE. The image is not displayed in the light-blocking region 100. On the other hand, a remainder of the circuit for controlling the luminance of the backlight assembly may be integrated into a driving integrated circuit 200. Alternatively, the entire circuit for controlling the luminance of the backlight assembly may be formed in the light-blocking region 100 or may be integrated into the driving integrated circuit 200.

The light-blocking region 100 or the reflective electrode RE includes an opening portion (not shown) so that the photo current sensing element $Q_{LT}$ is exposed through the opening portion, and the dark current sensing element $Q_T$ is not exposed. For example, the photo current sensing element $Q_{LT}$ may be disposed under the reflective electrode RE in the constant display region 'A'. Furthermore, information such as time, sound volume, mode, battery status, and the like, is displayed in the constant display region 'A', so that the resolution required to display the information is low. Thus, pixels in the constant display region 'A' have a greater size than those in the normal display region B. In addition, the pixels in the constant display region 'A' have reflective regions, so that a user may see an image displayed in the constant display region 'A' without any additional operation. Thus, the circuit for controlling the luminance of the backlight assembly may be formed under the reflective electrode RE.

When the method and the circuit for controlling the luminance of the backlight assembly are applied to a display device of a transmissive mode, the luminance of the backlight assembly is increased as the external luminance is increased. When the method and the circuit for controlling the luminance of the backlight assembly are applied to a display device of a reflective mode, the luminance of the backlight assembly is decreased as the external luminance is increased. Thus, image display quality may be improved, and power consumption may be decreased.

Figure 8:
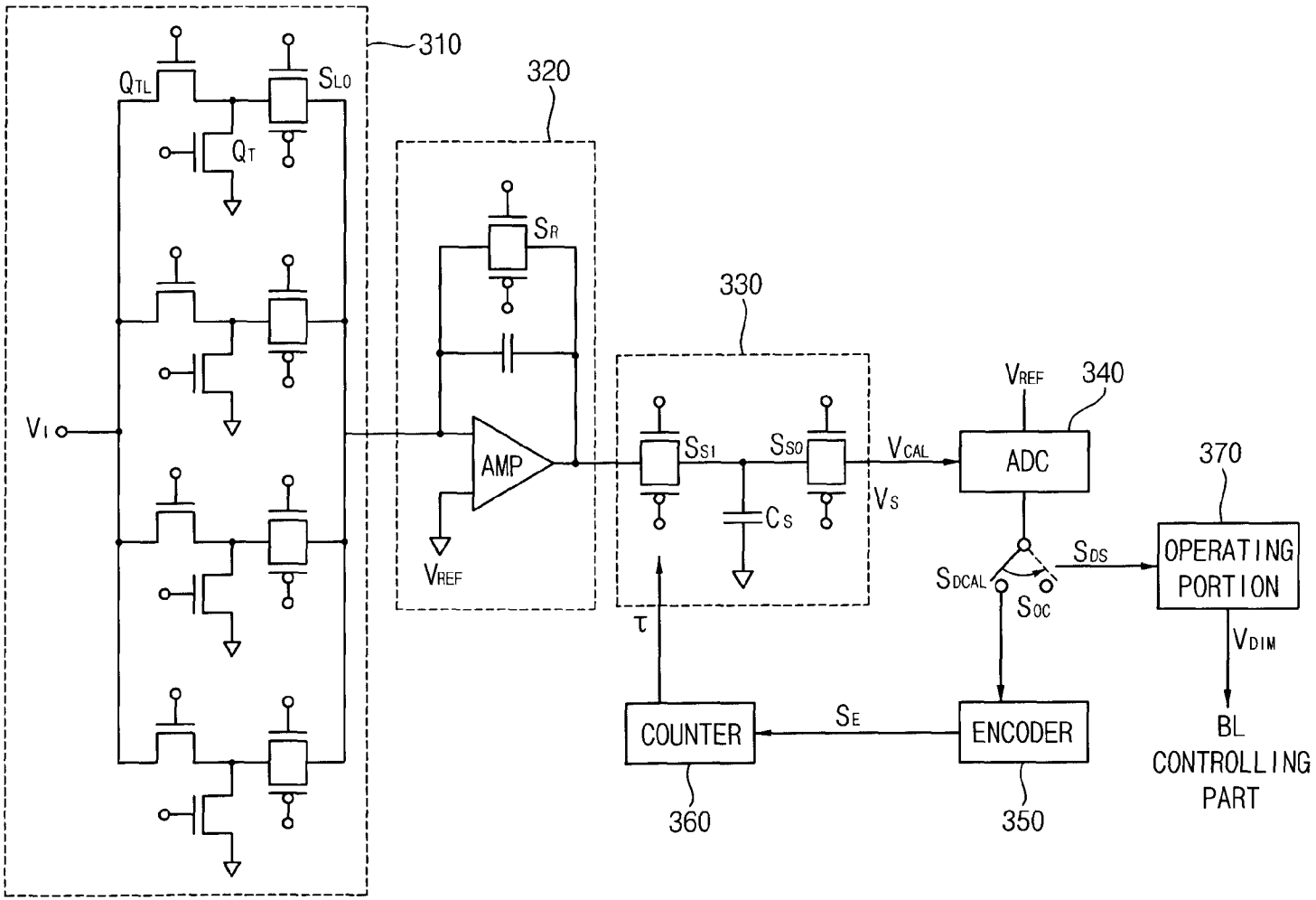
FIG. 8 is a circuit diagram illustrating a circuit for controlling a backlight assembly in accordance with an exemplary embodiment of the present invention.

FIG. 8 is a circuit diagram illustrating a circuit for controlling a backlight assembly in accordance with an exemplary embodiment of the present invention.

Referring to FIG. 8, the circuit for controlling the backlight assembly (not shown) includes a photo-sensing part 310, an amplifier 320, a sampler 330, an analog-to-digital converter (ADC) 340, an encoder 350, a counter 360, and an operating part 370.

In FIG. 8, a plurality of photo-sensing parts 310, as shown in FIG. 6A, are connected to each other, in parallel.

Alternatively, a plurality of the photo sensors, as shown in FIG. 5A, may be connected to each other, in parallel.

For example, an output switch $S_{LO}$ for controlling an output of the photo-sensing part may be electrically connected to an output terminal of the photo-sensing part 310. Alternatively, the output switch $S_{LO}$ for controlling the output of the photo-sensing part may be omitted by using control signals $V_{LT}$ and $V_T$ of the photo sensor, as shown in FIG. 6A. The photo-sensing part 310 selectively outputs a photo current $I_{(Temp, Lux)}$, a dark current $I_{(Temp)}$ or a net photo current $I_{(Lux)}$ to the amplifier 320.

The output signal of the photo-sensing part 310 and a reference voltage $V_{REF}$ are applied to a first input terminal of the amplifier 320 and a second input terminal of the amplifier 320, respectively, and an output terminal of the amplifier 320 is electrically connected to a controlling switch $S_{SI}$ of the sampler 330. The amplifier 320 amplifies the output signal applied to the photo-sensing part 310, so that the sampler 330 generates amplified sampling voltage $V_S$ or amplified calibrating voltage $V_{CAL}$. The amplifier 320 may further include a reset switch $S_R$ that resets the sampling voltage $V_S$ or the calibrating voltage $V_{CAL}$ of the sampler 330 as the reference voltage $V_{REF}$.

The sampler 330 includes a capacitor $C_S$, an input switch $S_{SI}$ for controlling an input of the sampler and an output switch $S_{SO}$ for controlling an output of the sampler. A first end of the capacitor $C_S$ is electrically connected to the output terminal of the amplifier 320, and a second end of the capacitor $C_S$ is electrically connected to a constant voltage terminal. The input switch $S_{SI}$ controls the input to the sampler 330. The output switch $S_{SO}$ controls the output of the sampler 330. The capacitor $C_S$ generates the sampling voltage $V_S$ or the calibrating voltage $V_{CAL}$ to apply the sampling voltage $V_S$ or the calibrating voltage $V_{CAL}$ to the ADC 340.

The ADC 340 receives the analog sampling voltage $V_S$ or the analog calibrating voltage $V_{CAL}$ and generates a digital sampling signal $S_{DS}$ or a digital calibrating signal $S_{DCAL}$. The digital sampling signal $S_{DS}$ is applied to a controlling part of the backlight assembly (not shown) through the output controlling switch $S_{OC}$, and the calibrating signal $S_{DCAL}$ is applied to the encoder 350 through the output controlling switch $S_{OC}$. The ADC 340 may be formed by assembling a plurality of comparators. Alternatively, the ADC 340 may have various known converting structures.

The encoder 350 receives the digital calibrating signal $S_{DCAL}$ of n bits and outputs an encoded signal $S_E$ of m-bits for generating a sampling timing signal $\tau$ to output the m-bit encoded signal $S_E$ to the counter 360, where m and n are natural numbers. For example, n may be greater than m. Alternatively, the encoder 350 may have various known encoding structures.

The counter 360 generates the sampling timing signal $\tau$ based on the encoded signal $S_E$ to determine a turn-on time of the input switch $S_{SI}$ for controlling the input to the sampler 330. Alternatively, the counter 360 may have various known counting structures.

The sampling voltage $V_S$ and the calibrating voltage $V_{CAL}$ of the sampler 330 are applied to the ADC 340, and the digital sampling signal $S_{DS}$ and the calibrating signal $S_{DCAL}$ are applied to the circuit for controlling the luminance of the backlight (not shown) or the encoder 350 through the output switch $S_{OC}$ for controlling the output of the sampler 330. Alternatively, the sampling voltage $V_S$ and the calibrating voltage $V_{CAL}$ of the sampler 330 are applied to a plurality of ADCs (not shown), respectively, through use of a control signal. The output of the ADC 340 is applied to the circuit for controlling the backlight assembly (not shown) through the operating portion 370 and to the encoder 340.

The circuit for controlling the backlight assembly may have various structures based on the required precision of controlling the backlight assembly and the timing of the sampling. For example, a size of the digital sampling signal $S_{DS}$ may be several bits, and the calibrating signal $S_{DCAL}$ may have a greater number of bits than the digital sampling signal $S_{DS}$ to precisely convert the sampling timing signal $\tau$. Thus, the ADC 340 receiving the sampling voltage $V_S$ may include several comparators electrically connected to each other, in parallel, however, the ADC receiving the calibrating voltage $V_{CAL}$ has a higher resolution than the ADC receiving the sampling voltage $V_S$.

Hereinafter, a method for controlling luminance will be explained with reference to FIGS. 8 and 9. $V_{LO}$, $V_R$, $V_{SI}$, $V_{SO}$, $V_{LT}$ and $V_T$ represent control signals applied to the output switch $S_{LO}$ for controlling the output of the photo-sensing part 310, a reset switch $S_R$, the input switch $S_{SI}$ for controlling the input of the sampler 330, the output switch $S_{SO}$ for controlling the output of the sampler 330, the photo current sensing element $Q_{LT}$ and the dark current sensing element $Q_T$, respectively.

A calibration period is a time period for generating a sampling timing signal $\tau$ so that final output of the sampling timing signal is independent from temperature, differences between elements, and deterioration due to long-term use.

In a reference voltage setting period, the output switch $S_{LO}$ for controlling the output of the photo-sensing part 310 and the output switch $S_{SO}$ for controlling the output of the sampler 330 are turned off and the reset switch $S_R$ and the input switch $S_{SI}$ for controlling the input of the sampler 330 are turned on, so that the reference voltage $V_S$ stored in the sampler 330 is discharged and the reference voltage $V_{REF}$ is stored in the sampler 330.

In a calibration voltage extracting period, the photo current sensing element $Q_{LT}$, the output switch $S_{SO}$ for controlling the output of the sampler 330 and the reset switch $S_R$ are turned off and the output switch $S_{LO}$ for controlling the output of the photo-sensing part and the input switch $S_{SI}$ for controlling the input of the sampler 330 are turned on, so that the high level control signal $V_T$ for controlling the dark current sensing element is applied to the dark current sensing element $Q_T$ and the reference voltage $V_{REF}$ of the sampler 330 is calibrated to the calibration voltage $V_{CAL}$ using the output signal of the photo-sensing part 310. The input switch $S_{SI}$ for controlling the input of the sampler 330 is turned on during a predetermined calibration voltage sampling period $\tau^0$, and the dark current $I_{(Temp)}$ flows towards the constant terminal. Thus, the calibration voltage $V_{CAL}$ is determined by the following Equation 1.

$$V_{CAL} = V_{REF} - \frac{1}{C_S}\int_0^{\tau_0} I_{(Temp)}\,dt \qquad \text{[Equation 1]}$$

In a sampling timing signal generating period, the output switch $S_{LO}$ for controlling the output of the photo-sensing part 310, the reset switch $S_R$ and the input switch $S_{SI}$ for controlling the input of the sampler 330 are turned off and the output switch $S_{SO}$ for controlling the output of the sampler 330 is turned on, so that the calibration voltage $V_{CAL}$ is applied to the ADC 340.

The ADC 340 converts the analog calibration voltage $V_{CAL}$ into an n-bit digital calibration signal $S_{DCAL}$, and outputs the digital calibration signal $S_{DCAL}$ to the encoder 350 through the output controlling switch $S_{OC}$.

The encoder 350 encodes the n-bit digital signal into an m-bit digital signal in accordance with a predetermined algorithm and transmits the encoded signal $S_E$ to the counter 360. The encoding algorithm between the n-bit digital signal and the m-bit digital signal is optimized in accordance with experimental data of the temperature, the photo current $I_{(Temp,\ Lux)}$, the dark current $I_{(Temp)}$ and the net photo current $I_{(Lux)}$, as well as the design of the encoder 350.

The encoder 360 receives the encoded signal $S_E$ and generates the sampling timing signal T.

In order to decrease the deviation of the sampling timing signal, which is caused by differences between elements and deterioration due to long-term use, the sampling timing signals T are sequentially sampled by the photo sensors that are electrically connected to each other in parallel, and an average value of a strong signal value may be set to be the output of the sampling timing signal T. For example, the counter 360 may further include a plurality of memories for storing the sampling timing signals, and the number of the memories may be substantially equal to the sampling timing signals.

Operation of the circuit of FIG. 8 during the operation period will be explained as follows. In the operation period, the luminance control signal $V_{Dim}$ is applied by the operating portion 370 to the backlight assembly (not shown) based on the external luminance.

Figure 9:
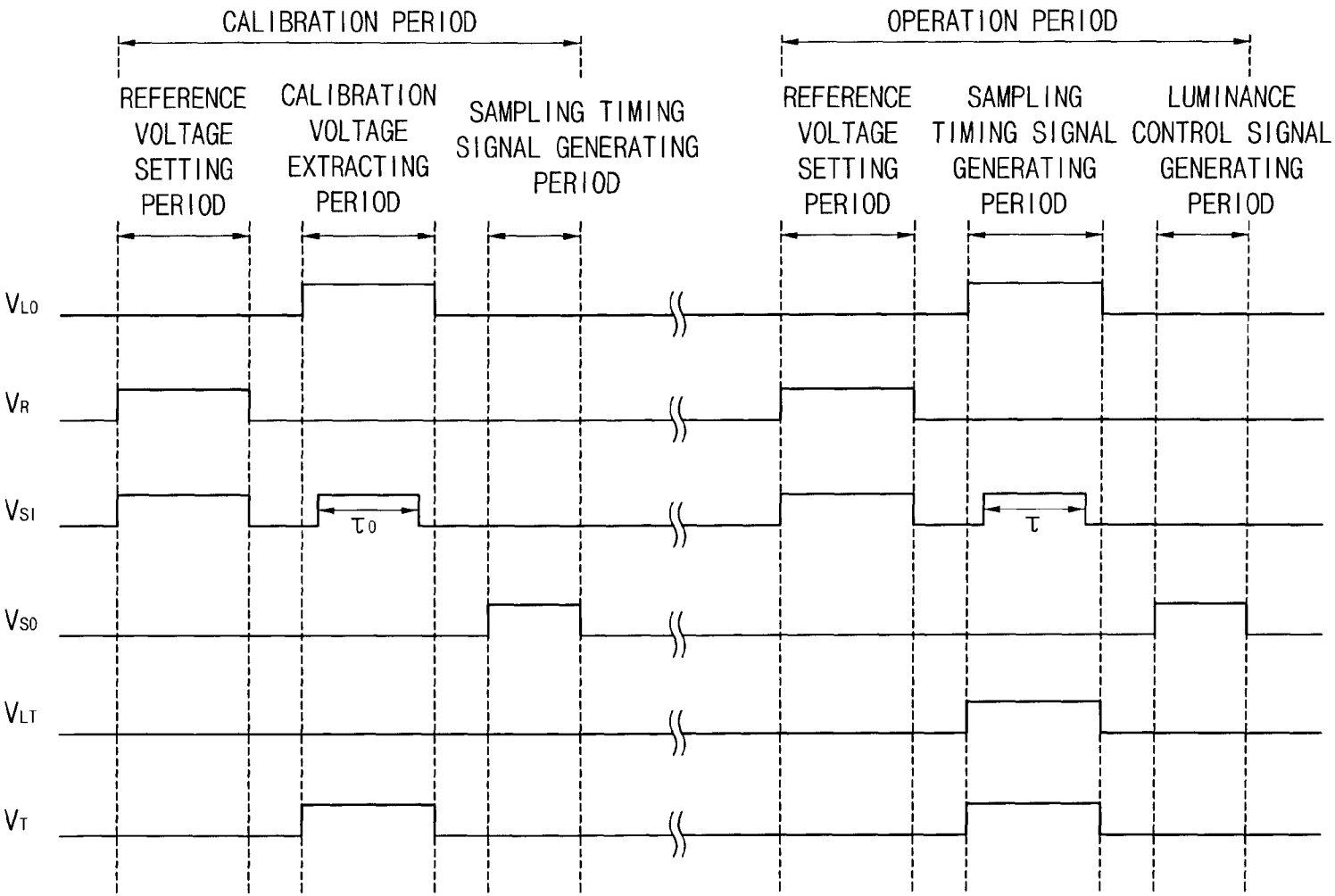
FIG. 9 is a timing diagram illustrating signals applied to the circuit for controlling the backlight assembly shown in FIG. 8.

As shown in FIG. 9, a first reference voltage setting period is substantially the same as the reference voltage setting period during the calibration period. Thus, any further explanations concerning the above-mentioned period will be omitted.

In a sampling voltage generating period, the reset switch $S_R$ and the output switch $S_{SO}$ for controlling the output of the sampler are blocked and the output switch $S_{LO}$ for controlling the output of the photo-sensing part 310 and the input switch $S_{SI}$ for controlling the input of the sampler 330 are turned on, so that the high level control signal $V_{LT}$ for controlling the photo-sensing element and the control signal $V_T$ for controlling the dark sensing element are turned off. The length of a period for turning on the input switch $S_{SI}$ for controlling the input of the sampler 330 is determined by the sampling timing signal T. When the net photo current $I_{(Lux)}$ generated from the photo-sensing part 310 flows toward the amplifier 320, the sampling voltage $V_S$ stored in the capacitor $C_S$ is determined by the following Equation 2.

$$V_S = V_{REF} + \frac{1}{C_S}\int_0^{\tau} I_{(Lux)}\,dt \qquad \text{[Equation 2]}$$

In a luminance control signal generating period, the input switch $S_{SI}$ for controlling the input of the sampler 330 is turned off and the output switch $S_{SO}$ for controlling the output of the sampler 330 is turned on. Other switches may be turned off to decrease power consumption. The ADC 340 converts the analog sampling voltage $V_S$ that is output from the sampler 330 into the digital sampling signal $S_{DS}$. The digital sampling signal $S_{DS}$ is applied to the counter 360 based on a control of an output switch $S_{OC}$ for controlling an output of the digital sampling voltage. The generation and application of the digital sampling signal $S_{DS}$ are performed using a plurality of the photo sensors though a time-division method. The counter 270 stores the sequentially transmitted digital sampling signals $S_{DS}$. After the final digital sampling signal $S_{DS}$ is applied to the counter 360, an average value of a strong signal of the digital sampling signals $S_{DS}$ is outputted to a controlling part of the backlight assembly (not shown) as a luminance controlling signal $V_{Dim}$ by the operating portion 370. The above-mentioned time division method is repeated for the photo sensors, thereby decreasing the error caused by the difference between the photo-sensing elements and the deterioration by the long time use.

The luminance controlling signal $V_{Dim}$ may be transmitted to a control system of the backlight assembly through a serial peripheral interface (SPI) or a low-speed serial interface so that an output pin may be omitted. For example, the low-speed serial interface may include an internal integrated circuit bus ($I^2C$) (not shown).

The luminance controlling signal $V_{Dim}$ may be transmitted by a predetermined interval based on the change of the external luminance and the power consumption. For example, the circuit for controlling the luminance may also be changed with reference to temperature variation.

In FIG. 8, the luminance of the backlight assembly is controlled using the net photo current $I_{(Lux)}$ that is dependent on the temperature. Alternatively, the luminance of the backlight assembly may be controlled using the photo current $I_{(Temp,\ Lux)}$. When the luminance of the backlight assembly is controlled using the photo current $I_{(Temp,\ Lux)}$, the control signals applied to the photo-sensing part 310 and the encoder 350 may be changed.

When the luminance of the backlight assembly is controlled using the net photo current $I_{(Lux)}$ that is independent from the temperature, the encoder 350 and the counter 360 may be omitted and the period for calibrating the sampling timing period T may be omitted. A constant sampling timing signal T may be used.

According to exemplary embodiments of the present invention, variation of the luminance of a backlight assembly may be minimized, although external luminance, temperature, variation between different photo sensors, the deterioration of the elements, and the like, may be changed.

This invention has been described with reference to the exemplary embodiments thereof. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A method of controlling luminance of a backlight assembly, the method comprising:

calibrating a sampling timing signal;

setting a reference voltage;

generating a sampling voltage based on one of a net photo current and a photo current signal generated by a photo current sensing element and/or a dark current sensing element with reference to the reference voltage;

generating a luminance control signal based on the sampling voltage and the sampling timing signal; and controlling the luminance of the backlight assembly using the luminance control signal, wherein the luminance control signal is generated by outputting an average value of a strong signal of a plurality of digital sampling signals as the luminance control signal.

2. The method of claim 1, further comprising:

changing a plurality of the sampling voltages of an analog type into the plurality of digital sampling signals; and storing the digital sampling signals.

3. The method of claim 2, wherein the luminance control signal is generated after steps of setting the reference voltage, generating the sampling voltage, changing the plurality of sampling voltages of an analog type into the plurality of digital sampling signals, and storing the plurality of digital sampling signals are repeated a plurality of times.

4. The method of claim 1, wherein the sampling timing signal is calibrated by:

generating a calibrating voltage based on the reference voltage and a dark current signal generated by the dark current sensing element;

converting the calibrating voltage of an analog type into a digital calibrating signal;

encoding the digital calibrating signal to generate an encoded signal; and generating the sampling timing signal based on the encoded signal.

5. A circuit for controlling luminance of a backlight assembly, comprising:

a photo-sensing part including a photo current sensing element and a dark current sensing element to output a photo current signal, a dark current signal, or a net photo current signal;

an amplifier holding a voltage level applied from an output terminal of the photo-sensing part, the amplifier receiving an output of the photo-sensing part and amplifying the output of the photo-sensing part;

a sampler electrically connected to an output terminal of the amplifier to generate a calibrating voltage or a sampling voltage and to output the calibrating voltage or the sampling voltage;

an analog-to-digital that converts the calibrating voltage of an analog type and the sampling voltage of the analog type from the sampler into a digital calibrating signal and a digital sampling signal, respectively; and an operating portion an average value of a strong signal of a plurality of the digital sampling signals as a luminance controlling signal.

6. The circuit of claim 5, wherein the operating portion stores the plurality of the digital sampling signals.

7. The circuit of claim 6, wherein the photo-sensing part further comprises a plurality of photo sensors including a photo current sensor and a dark current sensor.

8. The circuit of claim 5, further comprising:

an encoder that encodes an n-bit digital calibrating signal that is from the analog-to-digital converter into an m-bit encoded signal, wherein m and n are natural numbers; and a counter generating a sampling timing signal based on the encoded signal from the encoder.

9. The circuit of claim 8, wherein the sampler generates the sampling voltage based on the sampling timing signal.

10. The circuit of claim 5, wherein the analog-to-digital converter:

converts the calibrating voltage of the analog type from the sampler into the digital calibrating signal; and converts the analog sampling voltage from the sampler into the digital sampling signal.

* * * * *